US008439706B2

(12) United States Patent
Sytsma et al.

(10) Patent No.: US 8,439,706 B2
(45) Date of Patent: May 14, 2013

(54) PLUG CONNECTOR WITH EXTERNAL EMI SHIELDING CAPABILITY

(75) Inventors: Peter H. Sytsma, Maumelle, AR (US); Bradley C. Schoester, Maumelle, AR (US); Dennis Lee Doye, Maumelle, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/145,370

(22) PCT Filed: Jan. 20, 2010

(86) PCT No.: PCT/US2010/021465

§ 371 (c)(1),
(2), (4) Date: Aug. 24, 2011

(87) PCT Pub. No.: WO2010/085465

PCT Pub. Date: Jul. 29, 2010

(65) Prior Publication Data

US 2011/0300749 A1 Dec. 8, 2011

Related U.S. Application Data

(60) Provisional application No. 61/145,861, filed on Jan. 20, 2009.

(51) Int. Cl.
*H01R 13/648* (2006.01)

(52) U.S. Cl.
USPC ..... 439/607.46; 439/617.19; 439/607.58; 439/76.1

(58) Field of Classification Search ..... 439/607.17–607.19, 607.41, 607.44, 607.46–607.52, 76.1
See application file for complete search history.

(56) References Cited

U.S. PATENT DOCUMENTS

| | | | | |
|---|---|---|---|---|
| 6,116,955 | A | 9/2000 | Lazaro, Jr. | |
| 6,142,828 | A | 11/2000 | Pepe | |
| 6,200,163 | B1 | 3/2001 | O'Sullivan | |
| 6,953,897 | B2 | 10/2005 | Marroquin et al. | |
| 7,074,076 | B2 | 7/2006 | Richter | |
| 7,083,472 | B2 | 8/2006 | Gordon et al. | |
| 7,114,980 | B1 * | 10/2006 | Wu | 439/352 |
| 7,134,914 | B1 * | 11/2006 | Wu | 439/607.41 |
| 7,147,502 | B1 * | 12/2006 | Wu | 439/352 |
| 7,175,444 | B2 * | 2/2007 | Lang et al. | 439/76.1 |
| 7,214,097 | B1 | 5/2007 | Hsu et al. | |

(Continued)

OTHER PUBLICATIONS

International Search Report and Written Opinion of PCT Patent Application No. PCT/US2010/0021465, dated Nov. 3, 2010.

*Primary Examiner* — Ross Gushi
(74) *Attorney, Agent, or Firm* — Timothy M. Morella

(57) ABSTRACT

A shielded cable connector takes the form of a plug connector that is terminated to a plurality of wires of a cable. The wires are terminated to an edge card and a premold portion is formed thereover. An exterior shielding braid of the cable is extended over the premold and is formed with the connector housing so that a portion of it is exposed on the exterior of the connector housing. This exposed portion contacts an exterior conductive collar that is supported on the connector housing. The sleeve has a plurality of spring contact arms so as to make electrical shielding contact between the cable braid exposed on the connector housing and an exterior metal guide into which the connector is inserted when mating to an opposing connector.

24 Claims, 11 Drawing Sheets

U.S. PATENT DOCUMENTS 7,226,314 B2 * 6/2007 Lang et al. ..... 439/607.04
7,232,329 B1 * 6/2007 Wu ..... 439/358
7,249,974 B2 7/2007 Gordon et al.
7,261,582 B2 * 8/2007 Wu ..... 439/352
7,273,393 B2 9/2007 van Meijl
7,281,937 B2 * 10/2007 Reed et al. ..... 439/352
7,281,938 B1 * 10/2007 Wu ..... 439/353
7,303,438 B2 * 12/2007 Dawiedczyk et al. ... 439/607.53
7,331,822 B2 * 2/2008 Chen n ..... 439/607.01
7,344,409 B2 * 3/2008 Lang et al. ..... 439/607.04
7,364,465 B2 * 4/2008 Wu ..... 439/607.55
7,410,365 B2 * 8/2008 Wu ..... 439/76.1
7,445,484 B2 * 11/2008 Wu ..... 439/352
7,445,502 B2 * 11/2008 Zhang ..... 439/607.01
7,445,503 B1 * 11/2008 Zhang ..... 439/607.01
7,445,504 B1 * 11/2008 Zhang ..... 439/607.01
7,448,897 B2 * 11/2008 Dawiedczyk et al. ..... 439/357
7,491,089 B2 * 2/2009 Lang et al. ..... 439/607.01
7,540,755 B1 * 6/2009 Wu ..... 439/352
7,559,785 B1 * 7/2009 Wu ..... 439/352
7,572,138 B1 * 8/2009 Wu ..... 439/352
7,601,010 B1 * 10/2009 Wu ..... 439/76.1
7,618,264 B2 * 11/2009 Wu ..... 439/76.1
7,651,341 B2 * 1/2010 Wu ..... 439/76.1
7,651,342 B1 * 1/2010 Wu ..... 439/76.1
7,654,831 B1 * 2/2010 Wu ..... 439/76.1
7,666,023 B2 * 2/2010 Wu ..... 439/352
7,736,171 B2 * 6/2010 Reed et al. ..... 439/352
7,798,821 B2 * 9/2010 Liu et al. ..... 439/76.1
7,857,650 B1 * 12/2010 Wu ..... 439/352
7,891,986 B2 * 2/2011 Wu ..... 439/76.1
7,909,661 B2 * 3/2011 Wu ..... 439/701
7,938,669 B2 * 5/2011 Li et al. ..... 439/352
7,997,909 B2 * 8/2011 Xu et al. ..... 439/76.1
7,997,922 B2 * 8/2011 Dawiedczyk et al. ..... 439/357
8,062,052 B2 * 11/2011 Wu ..... 439/352
8,147,255 B2 * 4/2012 Wu ..... 439/76.1
8,152,568 B2 * 4/2012 Wu ..... 439/660
8,162,687 B2 * 4/2012 Dawiedczyk et al. ..... 439/357
8,202,122 B2 * 6/2012 Wu ..... 439/607.47
8,231,400 B2 * 7/2012 Phillips et al. ..... 439/357
8,241,045 B2 * 8/2012 Reed et al. ..... 439/76.1
8,251,733 B2 * 8/2012 Wu ..... 439/352
8,251,735 B2 * 8/2012 Wu ..... 439/353
2004/0198079 A1 * 10/2004 Aronson et al. ..... 439/76.1
2006/0009080 A1 * 1/2006 Regnier et al. ..... 439/637
2006/0014438 A1 * 1/2006 Regnier ..... 439/637
2006/0019525 A1 * 1/2006 Lloyd et al. ..... 439/352
2006/0040556 A1 * 2/2006 Neer et al. ..... 439/607
2006/0134961 A1 * 6/2006 Regnier et al. ..... 439/331
2006/0134985 A1 * 6/2006 Reed et al. ..... 439/607
2006/0134993 A1 * 6/2006 Dawiedczyk et al. ..... 439/676
2006/0160399 A1 * 7/2006 Dawiedczyk et al. ..... 439/374
2006/0160429 A1 * 7/2006 Dawiedczyk et al. ..... 439/676
2006/0189180 A1 * 8/2006 Lang et al. ..... 439/76.1
2006/0189197 A1 * 8/2006 Reed et al. ..... 439/352
2006/0189199 A1 * 8/2006 Lang et al. ..... 439/374
2006/0189211 A1 * 8/2006 Lang et al. ..... 439/607
2007/0105410 A1 * 5/2007 Wu ..... 439/76.1
2007/0117458 A1 5/2007 Winker et al.
2007/0161281 A1 * 7/2007 Wu ..... 439/352
2007/0173118 A1 * 7/2007 Chen ..... 439/607
2007/0232118 A1 * 10/2007 Wu ..... 439/353
2007/0243749 A1 * 10/2007 Wu ..... 439/352
2008/0020640 A1 * 1/2008 Zhang ..... 439/607
2008/0032541 A1 * 2/2008 Reed et al. ..... 439/352
2008/0085633 A1 * 4/2008 Dawiedczyk et al. ..... 439/583
2008/0166899 A1 * 7/2008 Lang et al. ..... 439/64
2009/0124124 A1 * 5/2009 Huang et al. ..... 439/607.02
2009/0156058 A1 * 6/2009 Wu ..... 439/607.18
2009/0197438 A1 * 8/2009 Liu et al. ..... 439/76.1
2009/0291584 A1 * 11/2009 Wu ..... 439/345
2010/0130063 A1 * 5/2010 Lang et al. ..... 439/607.17
2010/0203754 A1 * 8/2010 Li et al. ..... 439/345
2010/0210131 A1 * 8/2010 Reed et al. ..... 439/352
2010/0216325 A1 * 8/2010 Huang ..... 439/155
2010/0248544 A1 * 9/2010 Xu et al. ..... 439/607.04
2010/0317218 A1 * 12/2010 Wu ..... 439/352
2011/0034082 A1 * 2/2011 Zhu et al. ..... 439/607.41
2011/0045702 A1 * 2/2011 Su et al. ..... 439/607.56
2011/0059645 A1 * 3/2011 Wu ..... 439/460
2011/0065328 A1 * 3/2011 Wu ..... 439/660
2011/0086548 A1 * 4/2011 Wu ..... 439/607.41
2011/0136366 A1 * 6/2011 Hwang ..... 439/345
2011/0136368 A1 * 6/2011 Wu ..... 439/345
2011/0183535 A1 * 7/2011 Wu ..... 439/153
2011/0195586 A1 * 8/2011 Wu ..... 439/152
2011/0195590 A1 * 8/2011 Wu ..... 439/345
2011/0195592 A1 * 8/2011 McGrath et al. ..... 439/345
2011/0195593 A1 * 8/2011 McGrath et al. ..... 439/345
2011/0195595 A1 * 8/2011 Wu ..... 439/370
2011/0212643 A1 * 9/2011 Reed et al. ..... 439/345
2011/0223809 A1 * 9/2011 Reed et al. ..... 439/626
2011/0281455 A1 * 11/2011 Wu ..... 439/345
2011/0294333 A1 * 12/2011 Wu ..... 439/345
2011/0294334 A1 * 12/2011 Phillips et al. ..... 439/357
2011/0300735 A1 * 12/2011 Wu ..... 439/345
2011/0300749 A1 * 12/2011 Sytsma et al. ..... 439/607.01
2011/0306228 A1 * 12/2011 Wu ..... 439/345
2012/0015544 A1 * 1/2012 Wu ..... 439/345
2012/0015545 A1 * 1/2012 Wu ..... 439/345
2012/0040552 A1 * 2/2012 Wu ..... 439/358
2012/0156900 A1 * 6/2012 Wu ..... 439/76.1
2012/0214345 A1 * 8/2012 Wu ..... 439/607.19

* cited by examiner

PLUG CONNECTOR WITH EXTERNAL EMI SHIELDING CAPABILITY

REFERENCE TO RELATED APPLICATIONS

The Present Disclosure is a United States National Phase Application of PCT Patent Application No. PCT/US2010/0021465, entitled "Plug Connector With External EMI Shielding Capability," filed on 20 Jan. 2010 with the U.S. Receiving Office of the Patent Cooperation Treaty. The Present Disclosure claims priority to U.S. Provisional Application No. 61/145,861, entitled "Plug Connector With External EMI Shielding Capability," and filed 20 Jan. 2009, the contents of which is fully incorporated in its entirety herein.

BACKGROUND OF THE PRESENT DISCLOSURE

The Present Disclosure relates generally to plug connectors and more particularly to a plug connector with improved shielding.

Plug connectors are well known in the art as connectors terminated most often to a cable containing a plurality of wires, and configured to mate with an opposing mating connector. These plug connectors, as shown in U.S. Pat. No. 7,303,438, issued 4 Dec. 2007, typically utilize a circuit card with contacts arranged along a leading edge of the card as the mating portion of the plug connector. Such a connector has a housing formed from an insulative material. This connector is mated to an opposing connector and in order to mate, the plug connector is inserted into a hollow conductive shell member that is mounted on a circuit board.

Electromagnetic interference ("EMI") is prone to occur at the mating interface and along the body of such plug connectors and the shroud in which the plug connector is inserted has a loose fit around the exterior of the plug connector. At high speeds, this interference may cause problems with the signals transmitted through the connector. Shielding on the connector is one solution, but overall, such shielding is expensive and increases the cost of the plug connector. One solution is to form a conductive exterior housing that supports the circuit card. however, this solution is expensive. Plug connectors used in internal applications, i.e., connecting connectors within electronic devices such as routers and servers have sacrificed EMI capabilities in order to maintain small sizes and cost. For high speed applications, additional shielding is required for optimum performance. A need therefore exists for an improved internal connector with external EMI shielding capability.

The Present Disclosure is therefore directed to a plug connector with external EMI shielding capability which is inexpensive.

SUMMARY OF THE PRESENT DISCLOSURE

Accordingly, it is a general object of the Present Disclosure to provide an improved plug connector with an exterior grounding collar.

Another object of the Present Disclosure is to provide a plug connector for providing a connection from a plurality of wires to an opposing connector, each of the wires having a drain wire associated therewith and the wires being held within a cable, the cable including a conductive shielding braid, the braid being disposed on, or connected to a portion of the connector housing, and the plug connector including a conductive shielding collar that extends around a portion of the connector housing and which contacts the braid.

Yet another object of the Present Disclosure is to provide a conductive shielding collar for use on the aforementioned plug connector, the collar including a plurality of spring arms that press against the plug connector housing as well as press outwardly against any shield of a shell into which the plug connector is inserted, the collar further including means for engaging the plug connector housing so as to index the collar properly on the plug connector housing.

Still a further object of the Present Disclosure is to provide a conductive shielding collar for use on a plug connector, the shielding collar having a plurality of sides, the collar further having a configuration that is complementary to the configuration of the plug connector, the collar including a plurality of spring fingers formed with the collar and disposed on multiple sides of the collar, the spring fingers having inner and outer contact surfaces to provide multiple points of grounding contact between the plug connector and an exterior element, the collar further including means for indexing itself upon the plug connector.

Yet still another object of the Present Disclosure as exemplified by a second embodiment is to provide a connector for terminating a plurality of wires to a circuit board that is held in place within a molded housing, the wires being held in an outer cable of a shielding braid, the housing having an internal wire termination portion that has a conductive foil encompassing most of its exterior, the foil being contacted by an exterior conductive shielding collar that sits upon the connector housing, and the collar having a plurality of contact members for contacting both an exterior shell mounted in a circuit board in alignment with an opposing receptacle and the foil encompassing the inner wire termination portion.

Yet a still further object of the Present Disclosure is to provide a plug connector in which the cable shielding braid is supported by the plug connector housing and is contacted by a clip member that provides an exterior point of contact on the plug connector housing which the exterior shielding collar encloses, the collar having a plurality of spring arms formed in opposition to the clip member so as the extend the grounding capability of the cable braid to a location proximate to the forward mating face of the plug connector to provide EMI shielding along the body of the plug connector housing.

The Present Disclosure accomplishes these and other objects through its unique structure. In one embodiment of the Present Disclosure, a plug connector is provided with an insulative housing that encloses a plurality of wires of a cable. The cable has an outer shielding braid that encloses multiple wires, and the wires are typically arranged in pairs of wires so as to transmit differential signals. Each pair of differential signal wires preferably includes a drain, or ground wire, associated therewith. The drain wires and signal wires are terminated to respective ground and signal contact pads disposed proximate to a trailing edge of a circuit card that is utilized as the mating blade of the plug connector. These terminated wire ends and a portion of the circuit card are enclosed by an insulative premold portion that fixes the card and cable wires together as a unit so that it may be inserted as a single piece into a mold for the overmolding of the plug connector housing.

The circuit card projects through a front face of the plug connector and the connector may include one or more flanges extending out past the front face that serve to protect the circuit card and/or orient the connector in proper mating relation with an opposing mating connector. A hollow conductive collar is formed with a configuration complementary to that of the plug connector housing, and the collar takes the form of a sleeve that fits over and encloses a preselected length of the plug connector housing.

The cable braid is extended over the premold portion and the free ends of the braid are preferably exposed in the connector housing portion that is molded over the internal premold portion so as to provide one or more conductive areas on the plug connector housing that are exposed for contact by an opposing member. Extending the cable braid in this manner extends the shielding from the cable directly to the body of the plug connector. A metal clip or a foil cover may be further applied over the braid to provide a smooth conductive area on the exterior surface of the connector housing.

An exterior conductive shield is provided, preferably in the form of a hollow metal sleeve, or collar, that fits over the plug connector housing and which extends over at least a portion of the premold and its associated shielding braid. The sleeve has a plurality of spring arms, or fingers, that are formed with the sleeve as elongated cantilevered members which are located in opposition to the conductive areas disposed on the plug connector housing. The fingers are preferably curved in a slight S-shape so that portions of them extend both outside and inside of the sleeve. These fingers, when the sleeve is mounted on the plug connector, make contact with not only the plug connector housing conductive areas, but also they extend slightly outside of the sleeve to contact a metal shell, or shroud, that is positioned on a circuit board and into which the plug connector is placed when mated to an opposing mating connector. This shell is spaced apart from an opposing mating connector and serves as a guide for the plug connector.

The conductive collar may include slots and the like formed therein and disposed along edges thereof that engage portions of the plug connector. These slots not only engage the plug connector, but may also serve to properly position the sleeve on the plug connector housing.

A second embodiment also includes an internal premold section molded over the wires of the cable and circuit card termination area. The metal braid of the cable is incorporated into the connector having a part of the premold section. The clip members are applied to the premold section. A conductive foil is wrapped around the premold section and contacts the cable braid and clip member so as to provide shielding for substantially the entire length of the connector housing. Parts of the foil or clip member are exposed so as to contact the exterior shield.

The housing in this embodiment further includes secondary contact members held in places within slots, or recesses, formed in the housing and they serve as additional contact points between the internal foil tape of the premold and the exterior conductive shield. One of the secondary contact members has pairs of resilient upper and lower contact arms that extend into contact with the exterior shield as well as the conductive foil that surrounds the premold section. The other secondary contact member may take the form do a single spring held in a recess on the housing and which extends into contact with the premold foil and the exterior shield. The shield can also be configured with dimples that extend outwardly to define additional, district points of contact on the shield for contacting the metal shell of the mating connector.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

Figure 1:
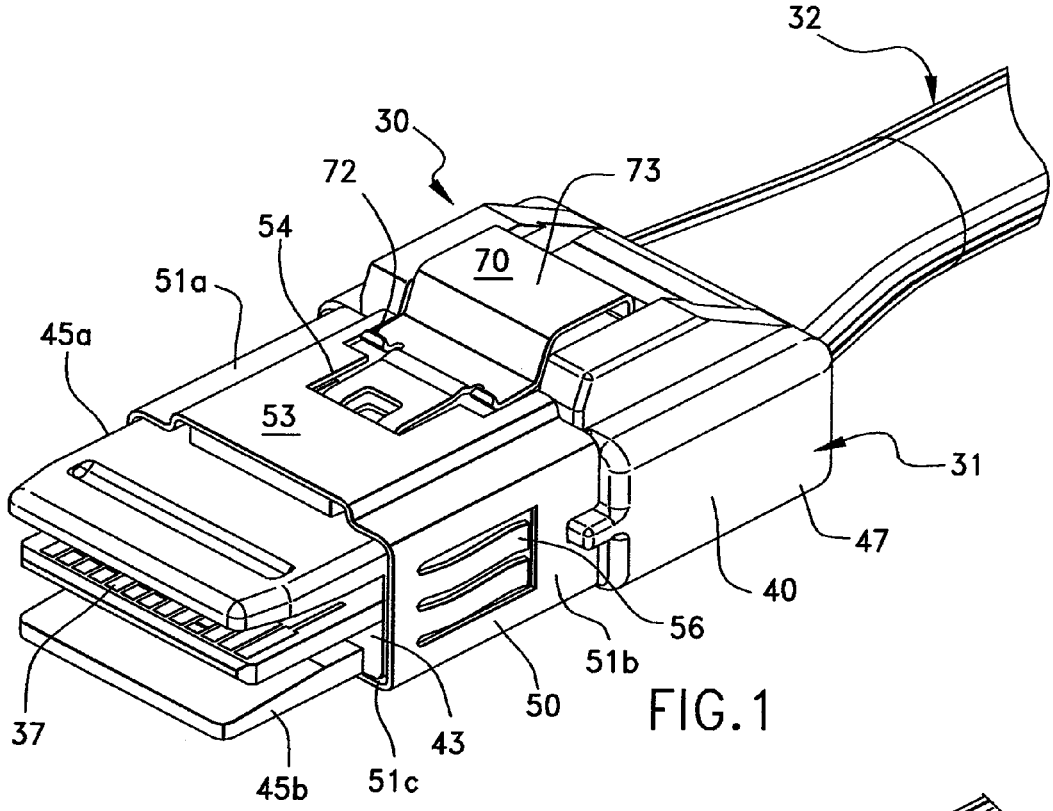
FIG. 1 is a perspective view of a first evident of use improved plug connector constructed in accordance with the principles of the Present Disclosure.

FIG. 1 is a perspective view of plug connector 30. Plug connector 30 is generally of the type that is disclosed in U.S. Pat. No. 7,303,438, issued 4 Dec. 2007 to the Assignee of the Present Disclosure, the contents of which is hereby incorporated by reference in its entirety. Such a plug connector may be utilized in internal applications where the plug and its cable provide a connection within an electronic device, such as, for example a router or server, or it may be utilized in an external application where the plug and cable are used to connect two electronic devices together. Plug connector 30 has an insulative body that is shown attached to cable 32 which contains a plurality of wires, typically arranged in pairs of differential signal wires 34, and each such wire pair includes drain, or ground wire, 35 associated with it. Wires 34 are contained within cable 32 and further are surrounded by conductive cable shield 59, typically in the form of a woven metal wire braid, but other conductive materials, such as for example, foils or the like may be used. As shown in U.S. Pat. No. 7,303,438, the plug connector fits into an outer metal shell that is aligned with a receptacle connector mounted to a circuit board.

Plug connector 30 includes insulative housing 31 that includes rear housing portion 40, front portion 42 and front face 43, which circuit card 33 projects past. The construction of such a plug connector housing is shown in U.S. Pat. No. 7,175,444, issued 13 Feb. 2007 to the Assignee of the Present Disclosure, the contents of which is hereby incorporated by reference. Circuit card 33 serves as the mating member, or blade, of connector 30 and includes, as is known in the art, a plurality of conductive traces that end in contact pads arranged along opposing leading (front) and a trailing (rear) edges of circuit card 33. Connector housing 31 may include one or more flanges 45*a*, 45*b*, extending forwardly of front face 43 and serve to protect the leading edge of the circuit card and orient the connector into proper mating alignment with an opposing mating connector (not shown). These flanges, the front part of circuit card 33 and the forward part of housing 31 may be considered to collectively define front portion 42.

Connector 30 may also include latch member 70 that is formed from a conductive material and which include a press portion, shown as button 73, which a user actuates to raise and lower contact lugs 72 and move them into and out of engagement with an exterior metal shell or shroud, not shown in the Present Disclosure but shown and described in U.S. Pat. No. 7,303,438, mentioned above. Latch member 70 fits into slot 71 shown disposed on the top of connector housing 31 and lugs 72 engage the opposing metal shell.

Rear portion 40 includes rear part 47 that is larger than mid portion 48 that interconnects front portion 42 and rear portion 40 together. One or more engagement members 49 shown as lugs 49 that project outwardly with respect to the connector housing mid portion 48. In profile in combination with rear portion 47, lugs 49 present a general T-shape configuration, which are utilized in orienting and engaging the opposing shell associated with the mating connector.

Figure 2:
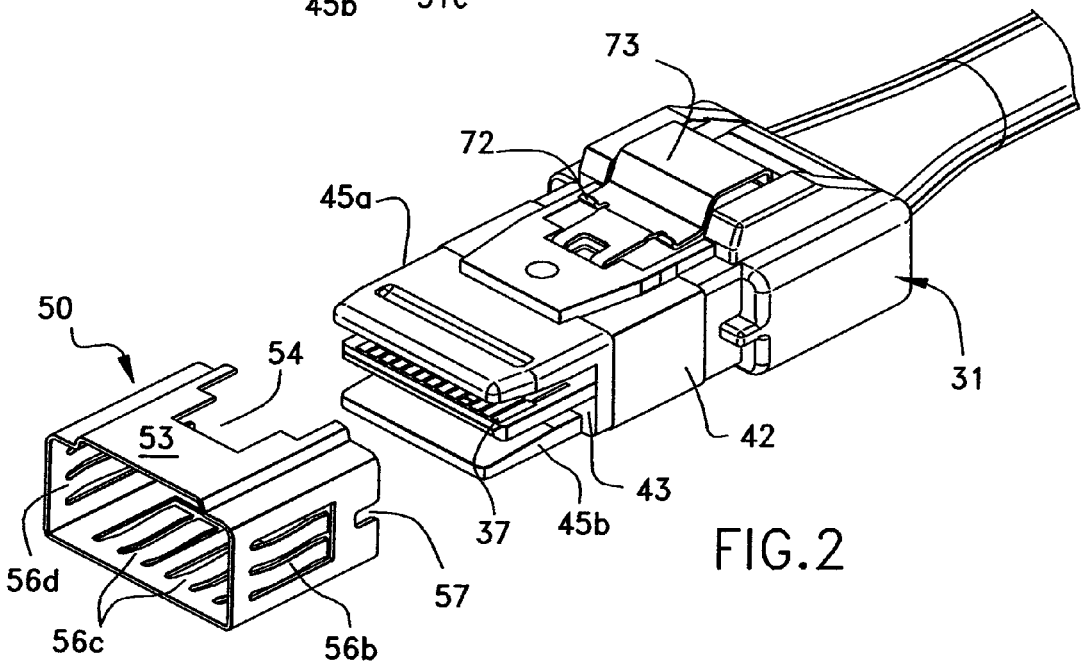
FIG. 2 is the same view as FIG. 1, but with the exterior shield collar portion thereof removed and spaced apart therefrom for clarity.

Turning to FIG. 2, the exterior conductive shield that has the form of a hollow collar, or sleeve 50 is shown. Sleeve 50 is formed from a conductive material such as a metal or a plated plastic or the like, and it preferably has a configuration that is complementary to that of the exterior surface of the connector housing in the area of its mid portion 48. As such, sleeve 50 has stepped portion 53 along its top side, or wall, as well as slot 54 at the trailing edge thereof, that partially surrounds a forward part of latch slot 71 and latch member 70.

Sleeve 50 has a plurality of walls or sides that are interconnected together and cooperatively define its hollow form. It can be seen best in FIG. 3 as including top wall 51*a*, right wall 51*b*, bottom wall 51*c* and left wall 51*d*. In order to provide electromagnetic interference protection to the plug connector, sleeve 50 is provided with multiple points of contact between sleeve 50 and connector housing 31 and an external shell into which the connectors are inserted when mated to an opposing connector. In this embodiment, these points of contact take the form of cantilevered spring contact arms, or slender members in the form of fingers 56 disposed on multiple sides of sleeve 50. Spring contact arms 56 are shown formed integrally as part of the sleeve in windows and the spring contact arms extend rearwardly along mid portion 47 and terminate in free ends. The spring contact arms are shown in a preferred arrangement in pairs on distinct sides of the sleeve, right wall arms 56*b*, bottom wall arms 56*c* and left wall arms 56*d*.

Figure 5:
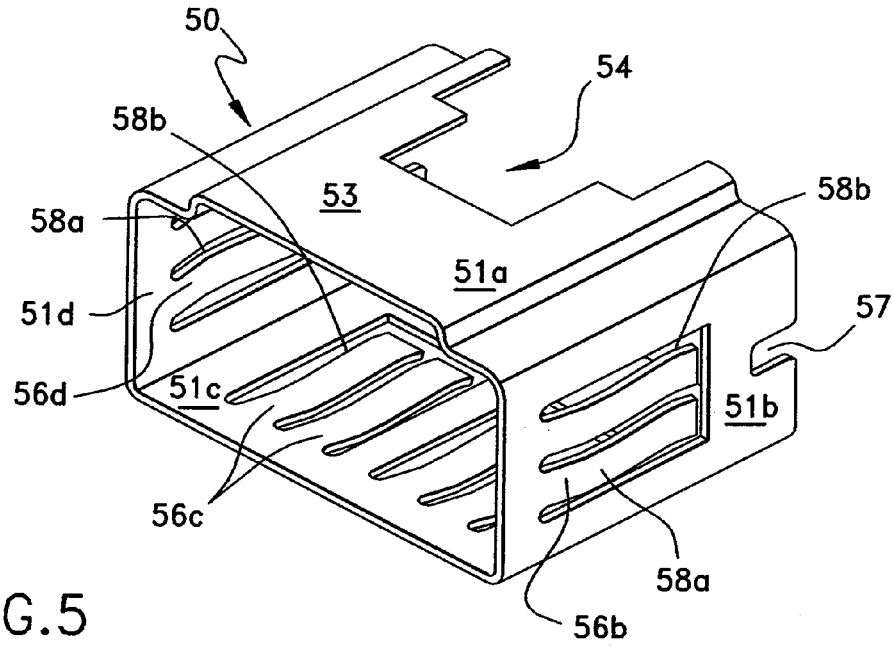
FIG. 5 is a perspective view of the shielding collar of the plug connector of FIG. 1.
Figure 6:
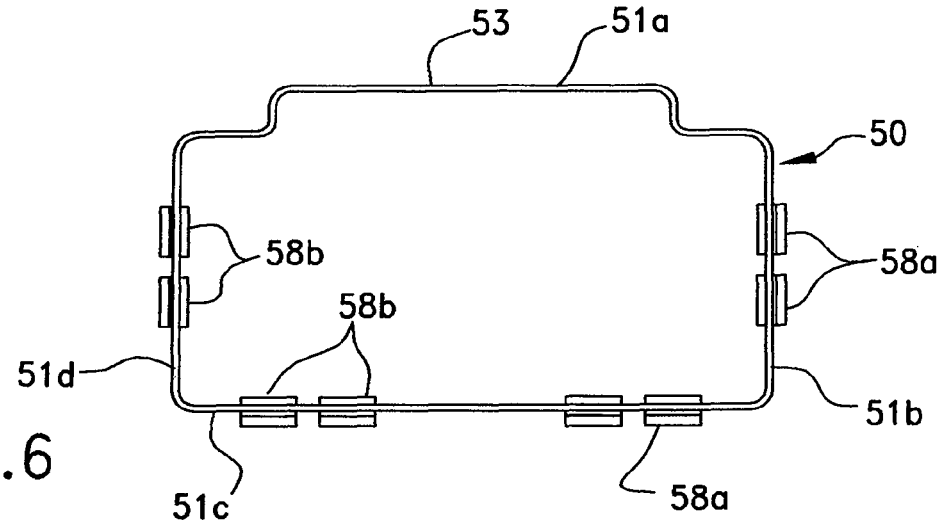
FIG. 6 is a front elevational view of the collar of FIG. 5.
Figure 7:
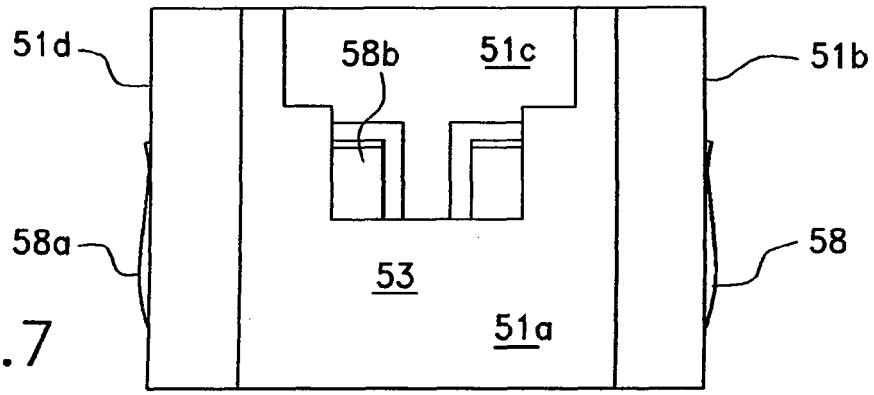
FIG. 7 is a top plan view of the collar of FIG. 5.
Figure 8:
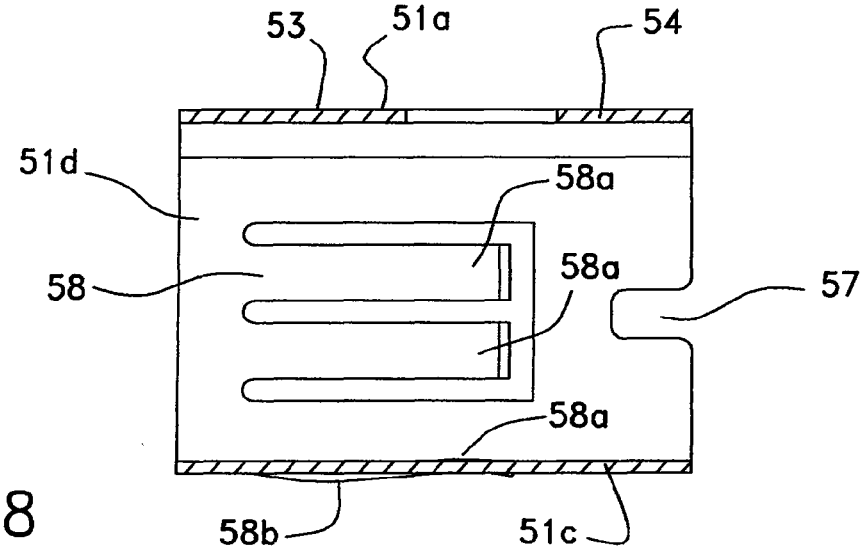
FIG. 8 is a sectional view of the of the collar of FIG. 5, taken along lines 8-8 thereof.

As best shown in FIG. 5, spring contact arms 56 have a general and preferably gentle S-shaped configuration in which they extend rearwardly and outwardly (or outside) of the sleeve and then curve back inside of the sleeve. This shape forms two opposing points of contact 58*a*, 58*b* on each spring arm 56. The one point of contact 58*a* occurs on the exterior of sleeve 50 (at the first bend of the S-shape), while other point of contact 58*b* occurs on the interior of sleeve 50 (at the second bend of the S-shape). Thus, the inner points of contact 58*b* will contact the exterior surfaces of plug connector housing 31, while the outer points of contact 58*a* will contact the interior surfaces of the external shroud, or shell, of the mating connector to which connector 30 is mated. The sleeve may also be preferably provided with slots 57 that engage lugs 49 formed on the connector housing and the trailing (rear) edge of sleeve 50 may abut the front edge of housing rear portion 47.

Figure 3:
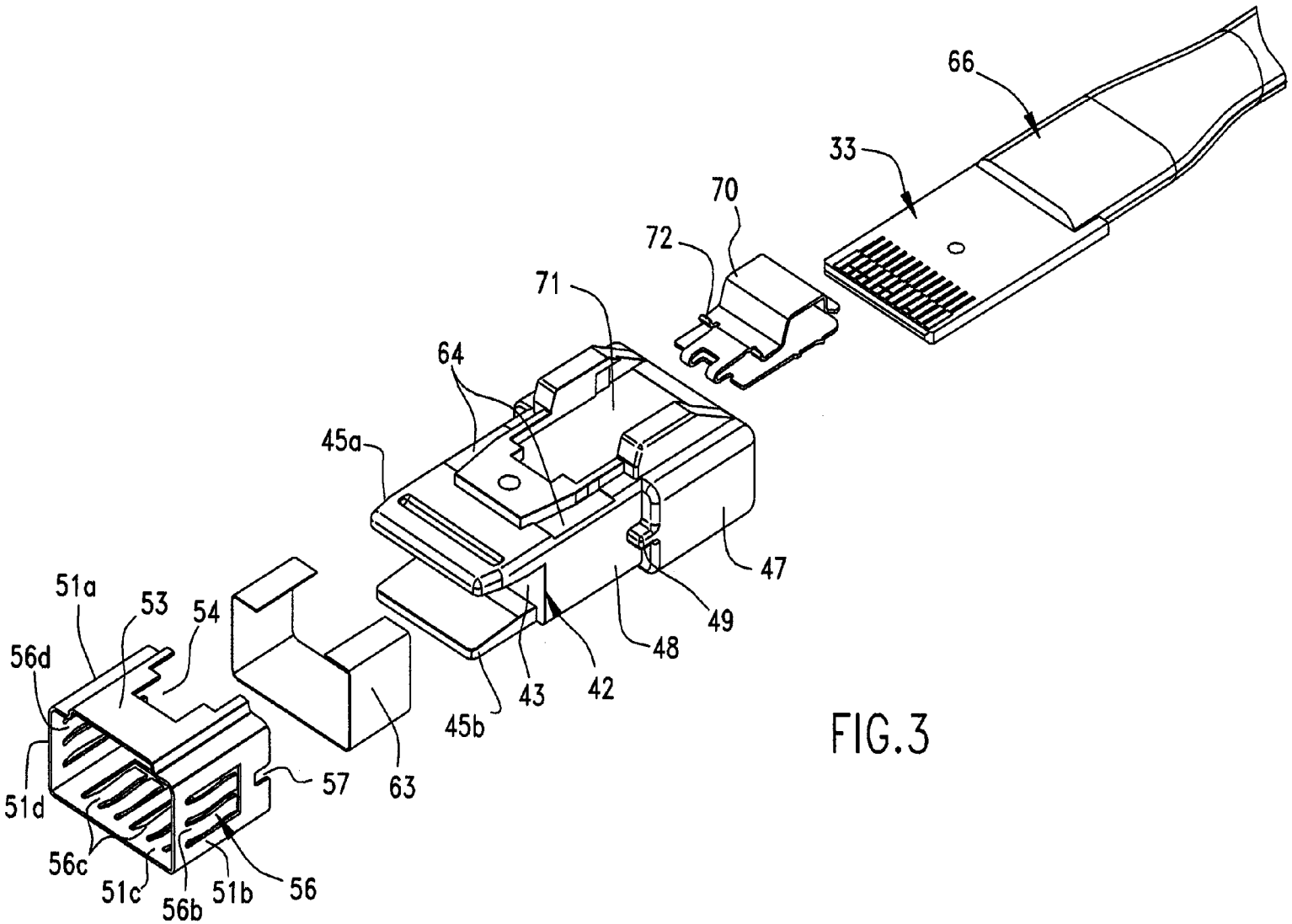
FIG. 3 is an exploded view of the plug connector and cable assembly of FIG. 1, illustrating the shielding collar, the connector, the connector latch, the connector grounding clip and the circuit card as attached to the cable.
Figure 4:
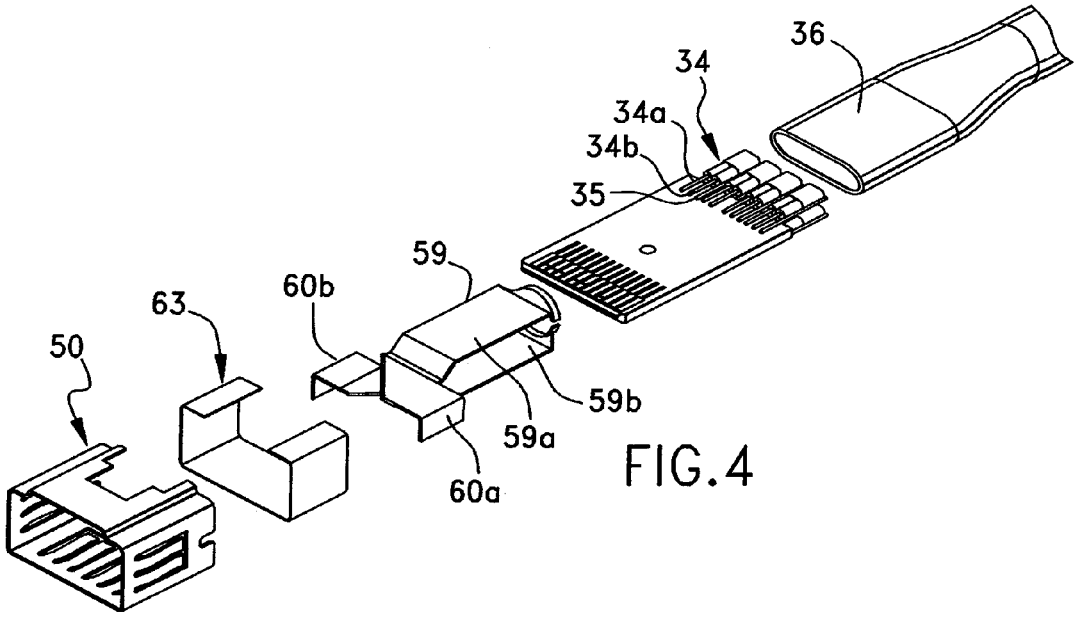
FIG. 4 is the same view as FIG. 3 but with the connector and its latch removedk, the wires shown attached to the circuit card and the cable grounding braid shown removed from the cable.

In order to provide a conductive, shielded area on connector housing 31, as shown best in FIG. 4, wires 34 of the cable are terminated to contact pads on circuit card 33 in the termination area that lies proximate to the trailing edge of the circuit card. As shown in FIG. 3, internal premold section 66 is molded over the free ends of the wire and the termination area to insulate the terminations. The foil from the individual pairs of wires may be unwrapped and the wrapped around premold section 66 and free ends of cable braid 59 (FIG. 4) extended over premold section 66 as well. Alternatively, a separate extent of foil may be used to wrap the premold section and make contact with the cable braid. As shown in FIG. 4, braid sections 59 may be separated into top and bottom sections 59*a*, 59*b* and they are applied to the exterior of premold section 66, or sections 59*a*, 59*b* can be formed separately as metal clips applied over the board. This foil extent extends the shielding of the cable forwardly to the connector premold section.

Plug connector housing 31 is then molded over premold section 66 and the braids are exposed and form part of the exterior surfaces of connector housing 31 in the area of housing mid portion 47. Conductive clip or foil 63 having the U-shape shown in FIG. 3 is placed over the exposed braid to form a smooth contact surface. It is this conductive surface that the spring contact arms, at points 58*b*, contact and so extend the shielding from the cable braid through the body of the connector and to an exterior surface thereof, terminating at the leading edge of sleeve 50, which is disposed at or proximate to front face 43 of connector 30. Foil 63 contacts left 60*a* and right 60*a* sides of braid 59 and so provides a conductive shield that extends completely around the connector housing in an encompassing manner.

Figures 9, 10:
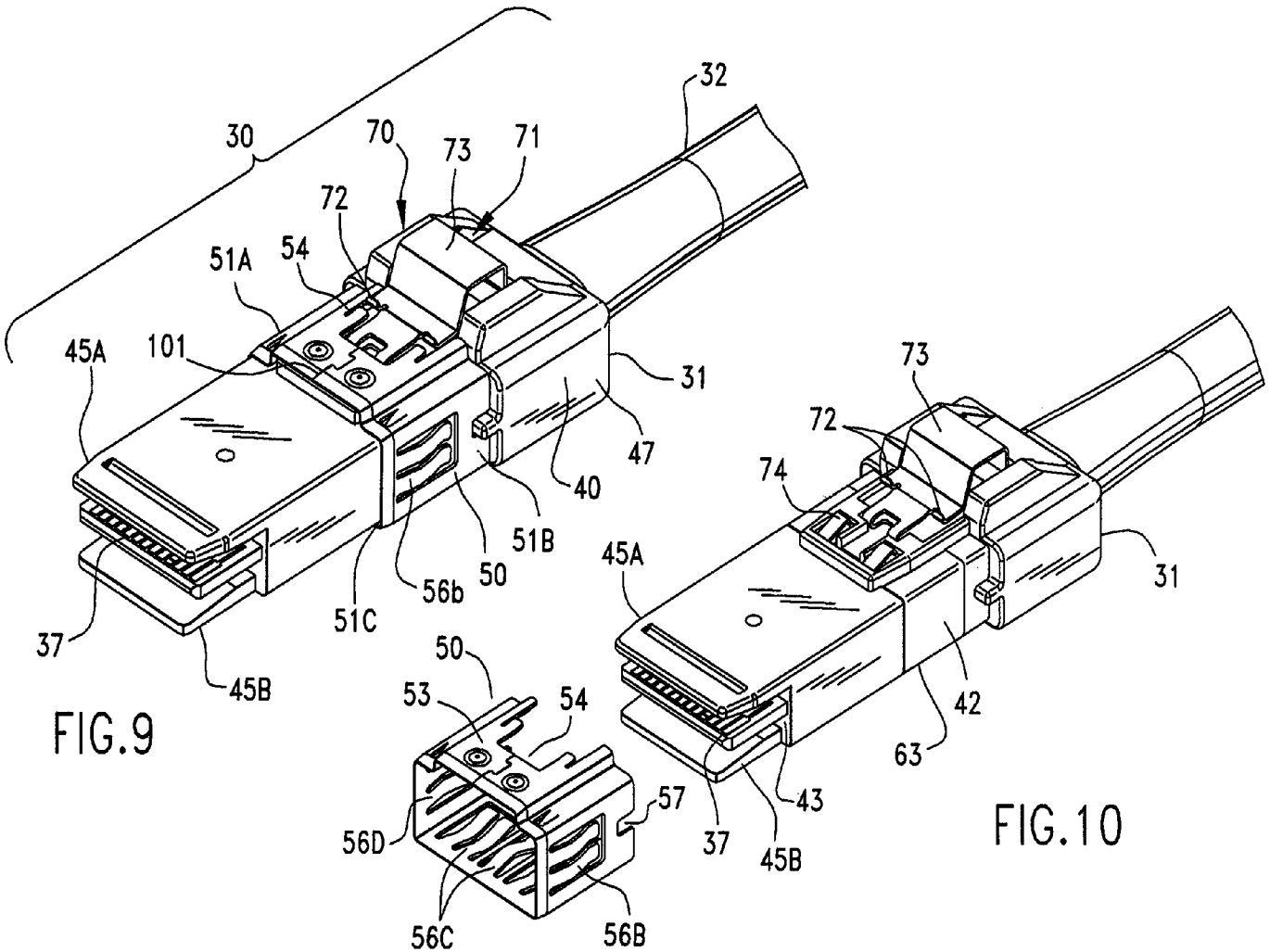
FIG. 9 is the same view as FIG. 1, but illustrating a second embodiment of the Present Disclosure.
FIG. 10 is the same view of FIG. 9, but with the exterior shielding collar thereof removed.
Figure 11:
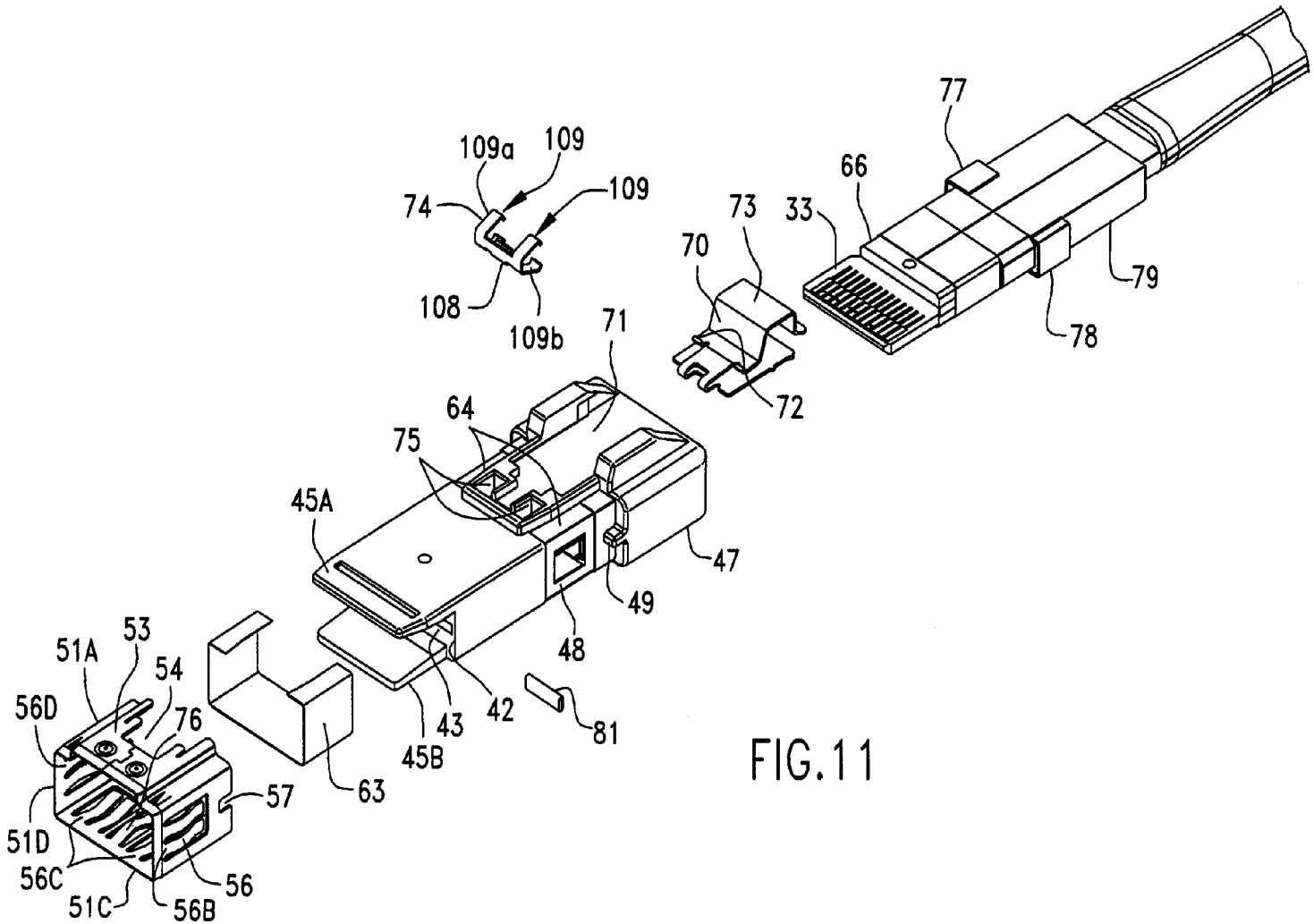
FIG. 11 is an exploded view of FIG. 9.
Figure 12:
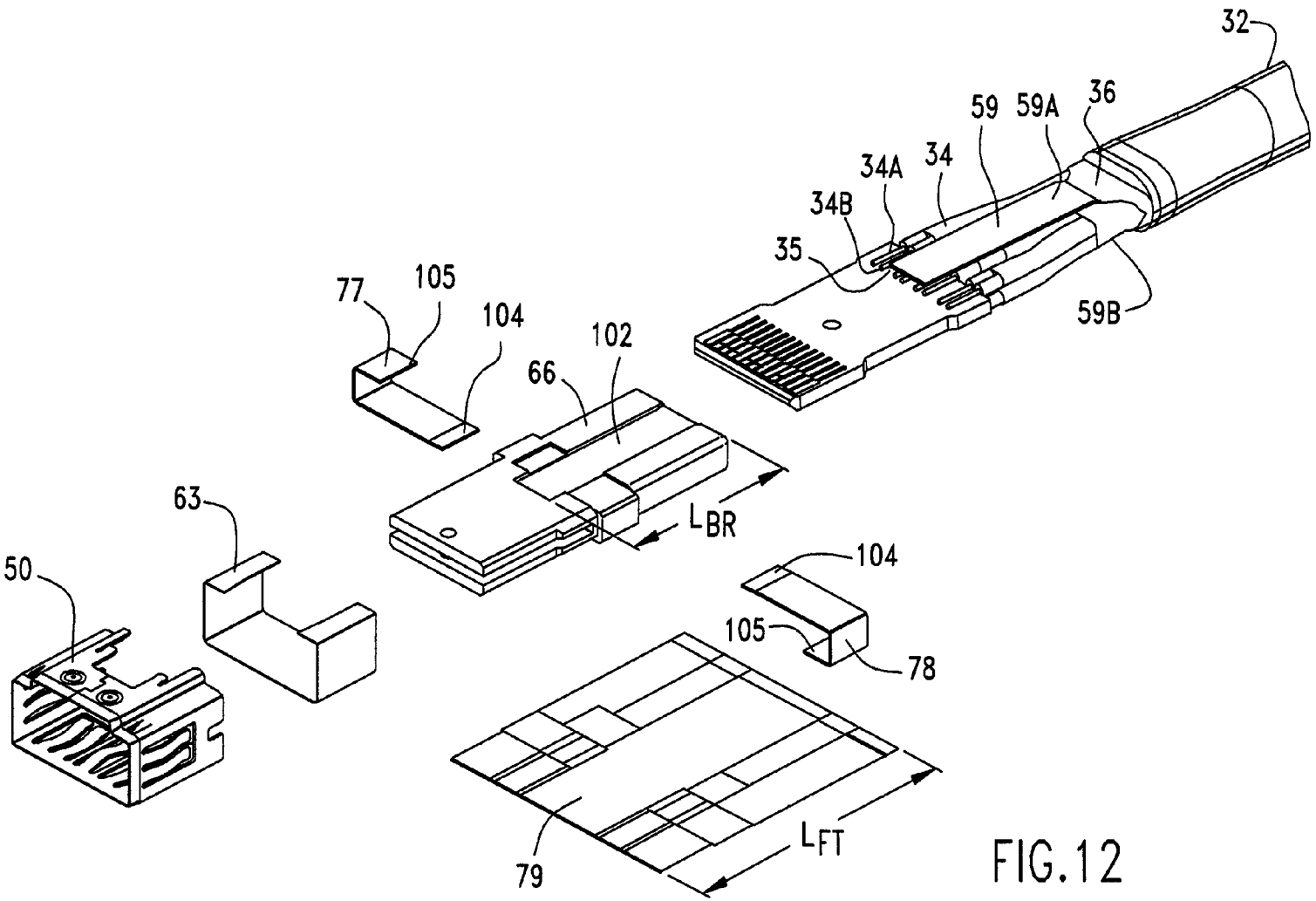
FIG. 12 is the same view as FIG. 11 but with the plug connector overmolded portion and latch member removed for clarity.

FIGS. 9-15 illustrate a second embodiment of the Present Disclosure which includes additional points of contact. The same reference numbers shall be used for structure that is common to both embodiments. As seen in FIG. 9, connector 30 has insulative housing 31 which supports conductive exterior shield 50 that takes the form of a hollow collar. The shield may be of one piece construction utilizing a sheet of metal that may be stamped and formed into its stepped shape, with its two free ends joined together at a joining line 101. FIG. 11 shows an exploded view of connector 30 with premold section 66 and overmolded connector housing 31 shown spaced apart for clarity. As shown in FIG. 12, cable 32 has exterior conductive braid 59 that is preferably divided into top and bottom portions, respectively 59*a*, 59*b*. Braid sections 59*a*, 59*b* are molded into premold section 66 so that they are exposed on the surface of premold section 66. In this regard, premold section 66 may be considered as being slots 102 that secure the braid sections, if braid sections 56*a*, 59*b* were removed from premold section 66. This forward extent of braid sections 59*a*, 59*b* extends the shielding of the connector forwardly for the length LBR (FIG. 12). Metal clips 77, 78, each having a general J-shape are provided as part of premold section 66. Each of long ends 104 of clips 77, 78 may be chamfered, or otherwise configured in an angled, or inclined, configuration to facilitate the insertion of the clips. Angled surfaces 104 of the long ends fit under short ends 105 of clips 77, 78.

Figure 16:
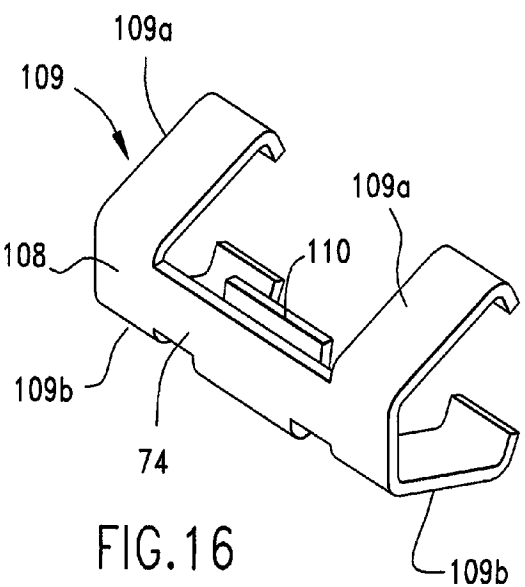
FIG. 16 is a perspective view of the top spring contact of the connector of FIG. 9.

Clips 77, 78 may be positioned either above or below braid sections 59*a*, 59*b*, but in either orientation, clips 77, 78 make contact with and conductively interconnect to braid sections 59*a*, 59*b*. A length of foil tape 79 is provided and it is applied to the internal premold section covering substantially all of its exterior surfaces. Housing 31 is substantially molded over premold section 66 in a manner such that portions of clip 77, 78 are exposed as part of the exterior surface of housing 31. Foil tape 79 creates an internal shielding layer on premold section 66 that has a length LFT which extends beneath the surface of housing 31 (FIGS. 12 and 16). Foil tape 79 contacts clips 77, 78 and the clips provide a conductive surface on the exterior of connector housing 31. Foil tape 79 extends the internal shielding of the cable braid forwardly past the forward edges of clips 77, 78 and cable braid, and as such length LFT is preferably longer than length LBR. U-shaped foil, or metal member, 63 is also preferably applied over housing 31 to create a conductive exterior contact surface that extends around most of internal premold section 66 to extend the shielding thereon to the forward end of premold section 66.

Figure 16A:
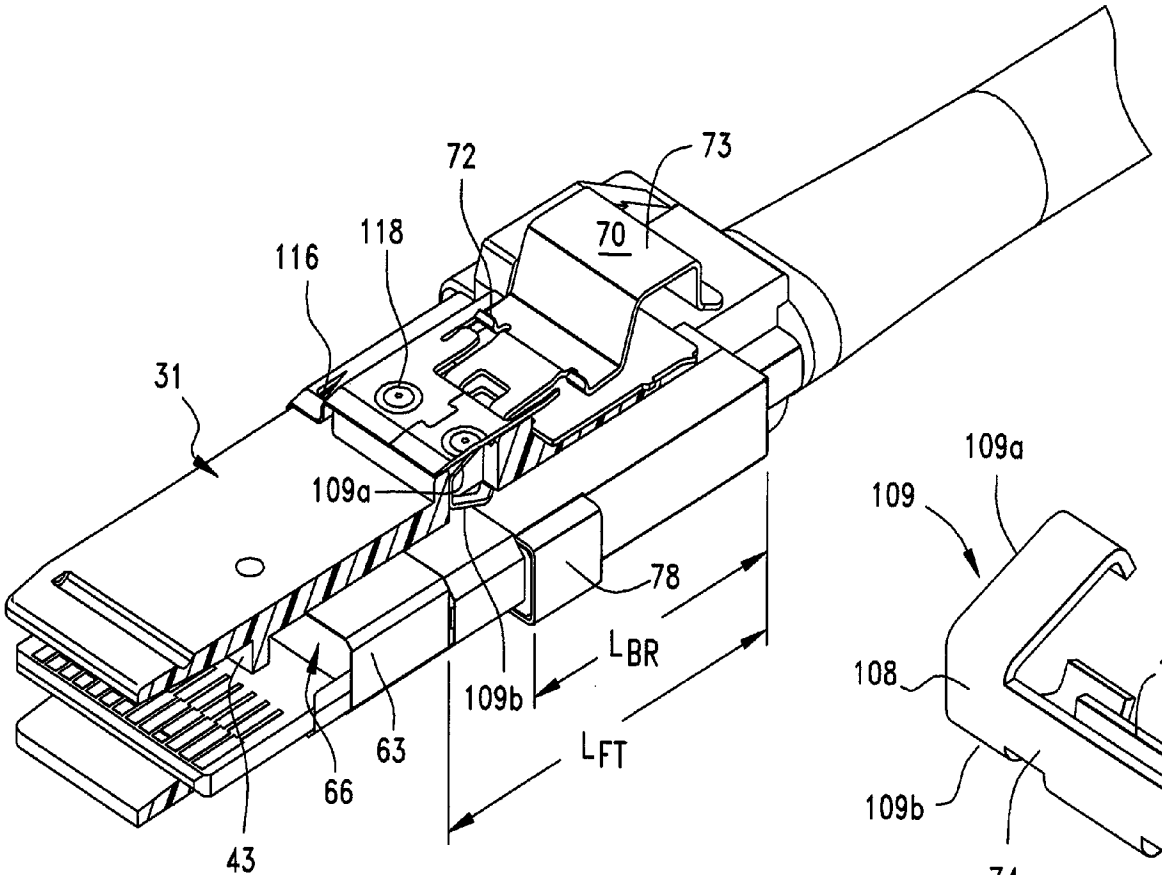
FIG. 16A is a cross-sectional view of FIG. 9 showing the contact between the second section and the spring contact.
Figure 16B:
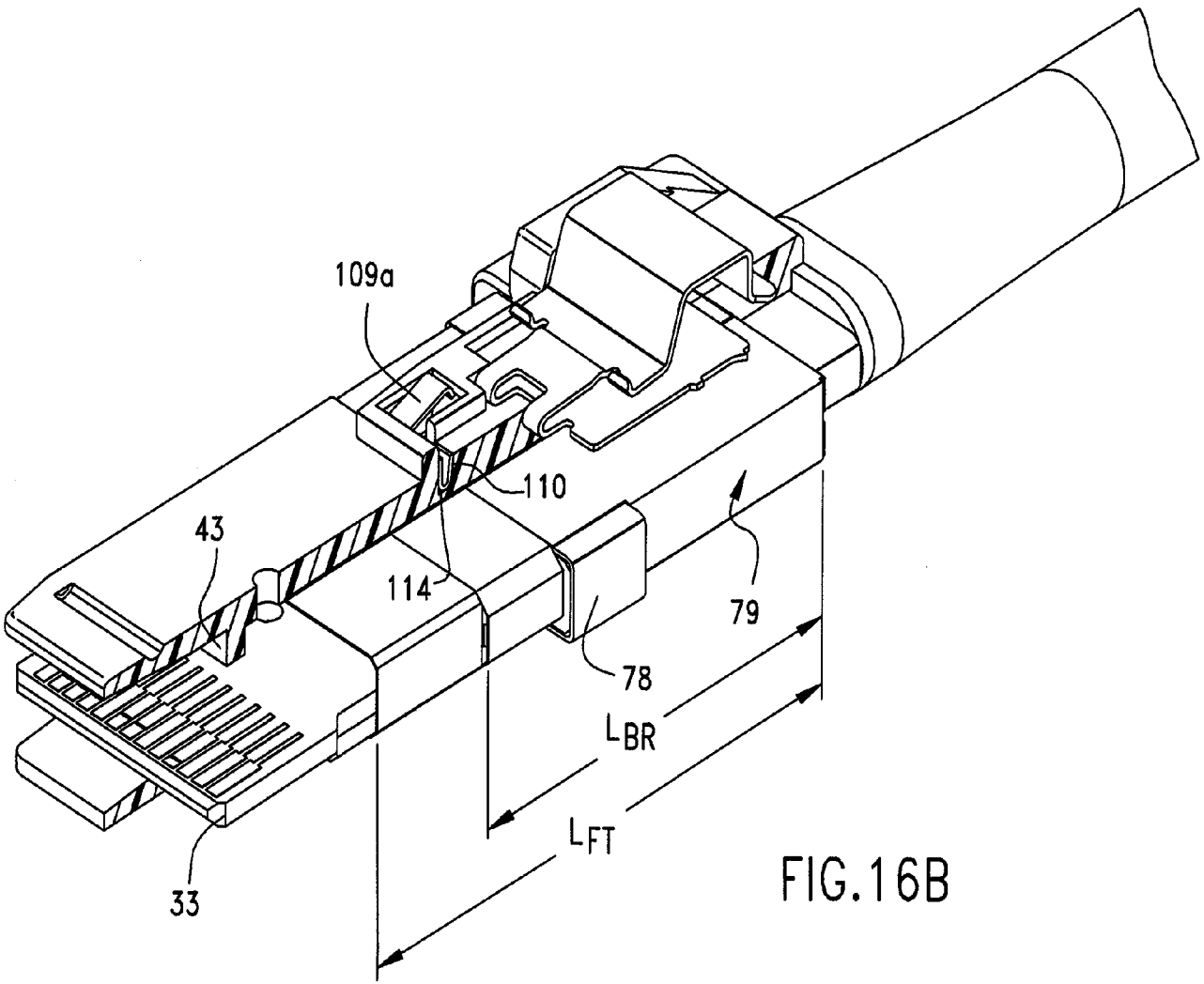
FIG. 16B is the same view as FIG. 16*a*, but sectioned to show the center of the upper spring contact of the connector housing.
Figure 16C:
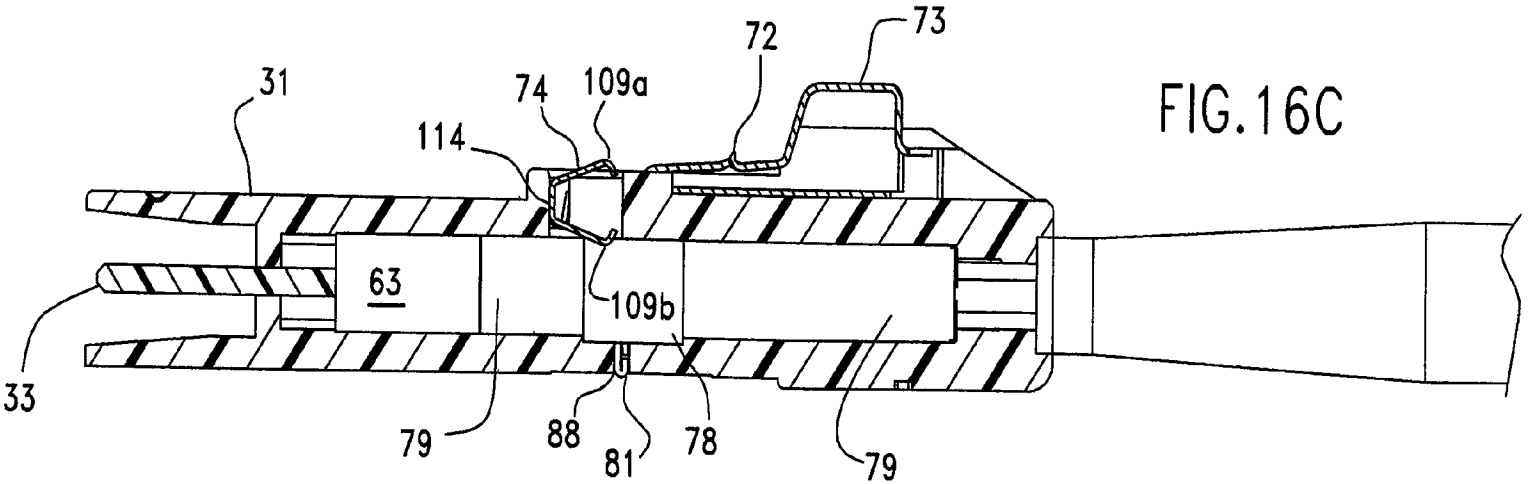
FIG. 16C is a sectional view taken through the centerline of the connector.
Figure 16D:
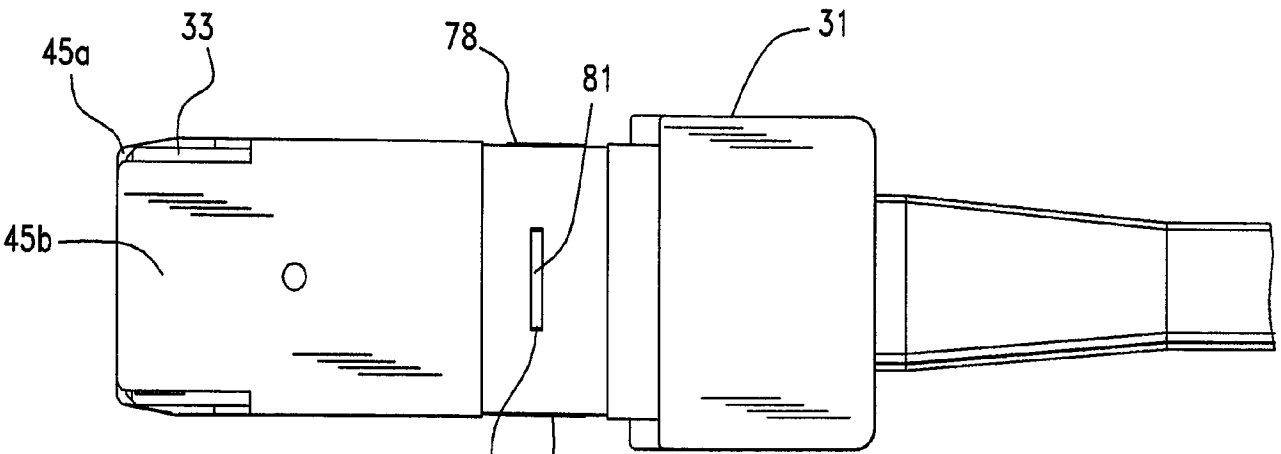
FIG. 16D is a bottom plan view of the connector housing of FIG. 9.

Two additional, secondary spring contacts 74, 81 are provided on the top and bottom surface of connector housing 31. Top contact 74 (FIG. 16) is shown as having backbone portion 108 with two pairs of contact arms 109 with upper and lower portions, respectively, 109*a*, 109*b*. Lower contact arms 109*b* extend into contact with foil tape 79 of the premold section while upper contact arms 109*a* extend up into contact with the inner surface of shielding collar 50. The center of backbone portion 108 of upper spring contact 74 has tab 110 bent back upon the backbone that forms a wedge portion that is retained within slot 114 formed in the upper surface of connector housing 31. As shown in FIG. 16A, upper contact arm 109*a* bears against the inner surface of shield 50, while lower contact arm 109*b* bears against foil tape 79 or clips 77, 78 supported by premold section 66. Lower contact areas 109*b* are shown in contact with foil type 79 wrapped over the middle portions of clips 77, 78 as shown in FIG. 16*a*.

Bottom spring contact 81 is held in a transverse recess, or slot 88, and it protrudes slightly past the bottom surface of housing 31 and it also contacts the inner surface of shield collar 50 along bottom side 51*c* thereof. The mating edge of shield 50 is preferably provided with ramp 112 that guides spring contact 81 into contact with shield 50. Both upper and lower spring contacts 74, 81 are preferably aligned on housing 31 with two clips 77, 78 so that contact is made between foil tape 79 on premold section 66 and exterior shield 50. Additionally, it is preferable that the secondary contacts be aligned with side spring fingers 56*b*, 56*d* so that all of these points of contact provide a shielding contact that extends radially around the perimeter of connector housing 31 and electrically connects the exterior shield to inner foil tape 79.

Figure 13:
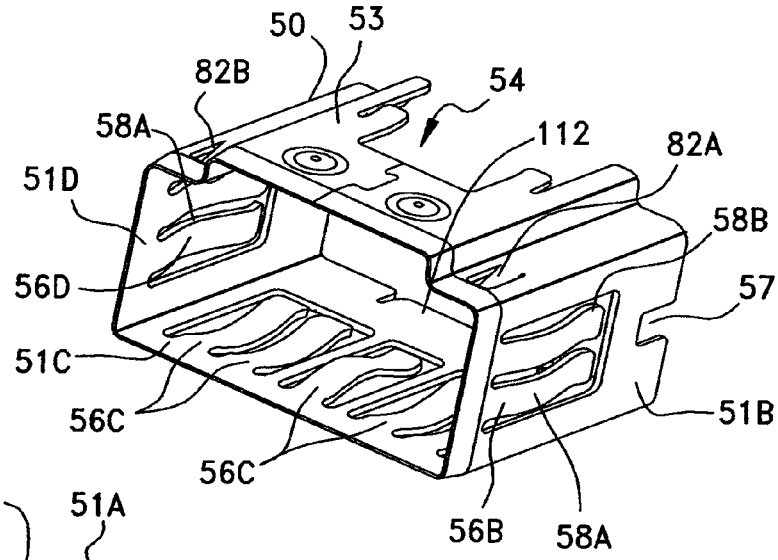
FIG. 13 is a perspective view of the exterior shielding collar of the connector of FIG. 9.
Figure 14:
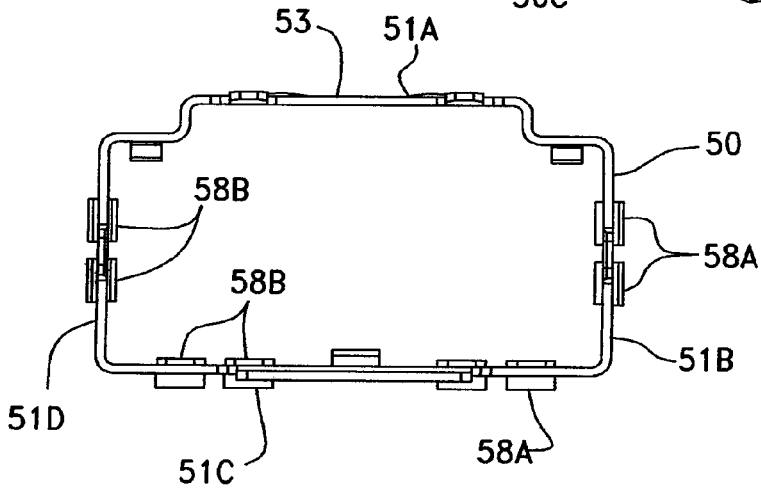
FIG. 14 is a rear elevational view of the shielding collar of FIG. 13.
Figure 15:
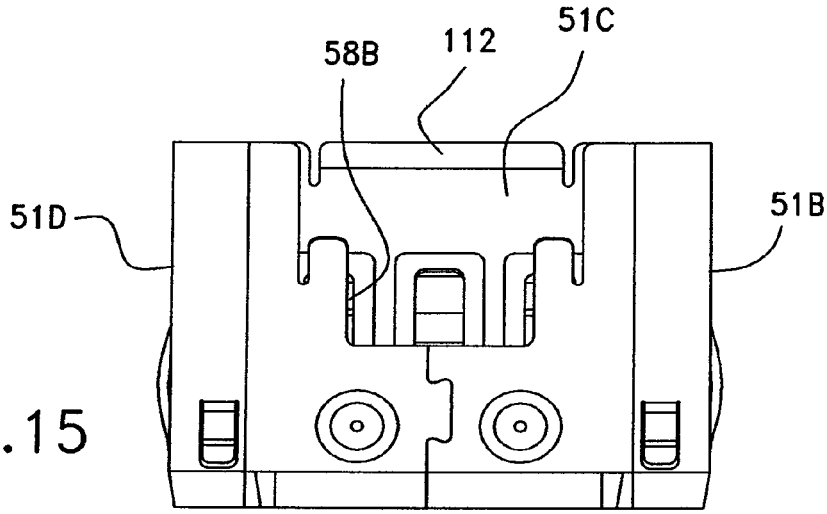
FIG. 15 is a top plan view of the shielding collar of FIG. 13.

Shielding collar 50 of this embodiment as shown in FIG. 13 has pair of tabs 81*a*, 82*b* that are stamped in the top surface thereof proximate to the leading edge of the shield, and are disposed on opposite sides of shielding collar stepped portion 53. Tabs 82*a*, 82*b* engage recesses 116 in the connector housing top surface and they serve to assist in holding exterior shielding collar 50 in place on the connector housing.

Shielding collar 50 may also include a pair of raised dimples, or other projections 118, found in the top of stepped portion 53 of shielding collar 50 so as to contact the inner surface of the metal shield of the mating connector. Two other tabs 120 are formed near latch 70 and are slightly upturned to provide two more additional points of contact. Shielding collar 50 of this embodiment also has additional contact arm 56*e* formed in the bottom wall thereof (FIG. 13). Contact arm 56*e* is bent in an opposite direction from other contact arms 56*c* of bottom wall 51*c*. This provides a measure of redundant contact with connector housing 31.

While a preferred embodiment of the Present Disclosure is shown and described, it is envisioned that those skilled in the art may devise various modifications without departing from the spirit and scope of the foregoing Description and the appended Claims.

What is claimed is:

1. A cable connector for connecting a plurality of wires to a mating connector, the cable connector comprising:

a connector housing, the housing having a front face and a rear portion interconnected by a body portion, the rear portion receiving the wires therein and the front face including a circuit card that extends partially past the front face, the circuit card including a contact, for mating with the mating connector, and a termination area, the termination area being rearwardly disposed with respect to the leading edge for termination to the wires, the connector housing including at least one flange extending forwardly of the connector housing front face; and a conductive exterior shield disposed on the connector housing, the shield including a hollow collar having multiple sides and a preselected length that extends lengthwise along the connector housing, the collar including contact members disposed on multiple sides of a sleeve for contacting exterior surfaces of the connector housing and interior surfaces of a shell into which the cable connector is inserted when mating to the mating connector.

2. The cable connector of claim 1, wherein the connector housing includes a pair of opposing sides, at least one engagement member being disposed on one of the sides, and the collar includes a engagement member complementary in shape to the connector housing engagement member, the collar and connector housing engagement members engage each other to position the collar on the connector housing.

3. The cable connector of claim 1, wherein the shield has a leading edge proximate to the front face.

4. The cable connector of claim 1, wherein some of the contact members are arranged in pairs on some of distinct sides of the collar.

5. The cable connector of claim 4, wherein the contact members include cantilevered spring arms disposed on three distinct sides of the collar.

6. The cable connector of claim 1, wherein the contact members extend lengthwise in a cantilevered fashion, each contact member including a general S-shaped configuration, defining two points of contact on the contact member.

7. The cable connector of claim 6, wherein one of the points of contact of the contact members extends inside of the collar and the other point of contact extends outside of the collar.

8. The cable connector of claim 1, further including a cable enclosing the wires, the cable including an exterior shielding element, the exterior shielding element being extended from the cable and exposed on an exterior portion of the connector housing, the sleeve overlying and contacting the exterior shielding element.

9. The cable connector of claim 1, further including a cable enclosing the wires, the cable including a shielding braid, the shielding braid being extended from the cable and supported on an internal portion of the connector housing.

10. The cable connector of claim 9, wherein the connector housing further includes an internal portion and the shielding braid is supported by the internal portion.

11. The cable connector of claim 10, further including at least one conductive clip that extends over and contacts the shielding braid, the clip including at least one surface thereon exposed on an exterior surface of the connector housing for contacting the exterior shield.

12. A plug connector for connecting a plurality of wires to an opposing connector, the plug connector comprising:

a connector housing for receiving free ends of the wires, the housing supporting a circuit card therein, a forward end of the circuit card extending therefrom to define a mating blade of the connector;

a conductive shielding collar disposed on the connector housing, the shielding collar having a plurality of sides and including a plurality of primary contact portions arranged on the sides for contacting a conductive shell associated with the opposing mating connector; and an internal body portion enclosing the wire free ends and at least a portion of the circuit card, the internal body portion supporting at least one length of a metal shielding braid from a cable enclosing the wires, and including a conductive extension member disposed on at least a portion of the internal body portion connected to the shielding braid.

13. The plug connector of claim 12, wherein the housing overlies the internal body portion, and at least one surface of the extension member is exposed through the housing and in contact with the shielding collar.

14. The plug connector of claim 12, further including at least one conductive clip that contact the shielding braid, a surface of the clip extending through the connector housing for contacting the shielding collar.

15. The plug connector of claim 12, wherein the extension member includes a length of conductive foil extending around the internal body portion, the foil contacting the shielding braid.

16. The plug connector of claim 15, wherein the connector housing includes at least a first slot formed therein for receiving a first secondary contact which contacts at opposite ends thereof the foil and the shielding collar.

17. The plug connector of claim 16, further including a second secondary contact disposed in a second slot of the connector housing, the second secondary contact contacting, at opposite ends thereof, the foil and the shielding collar.

18. The plug connector of claim 17, wherein the first and second secondary contacts are disposed on opposite sides of the connector housing.

19. The plug connector of claim 18, wherein at least two of the primary contact portions are aligned with the first and second secondary contacts.

20. The plug connector of claim 16, wherein the first secondary contact includes at least one pair of opposing contact arms extending between the foil and the shielding collar.

21. A cable connector for connecting a plurality of wires to contacts of a mating connector, the cable connector having improved shielding capability, the cable connector comprising:

a cable , the cable including a plurality of wires housed therein and a conductive shielding braid that provides shielding to the wires;

a circuit card having a leading edge, free ends of the wires being terminated to the circuit card and spaced apart from the leading edge;

an internal body portion encompassing the wire free ends and a portion of the circuit card while leaving the leading edge exposed, the shielding braid being extended from the cable and supported by the internal body portion;

a conductive extension member encompassing the internal body portion, the conductive extension member contacting the shielding braid;

an insulative exterior housing overlying the internal body portion such that at least one portion of the conductive extension member is exposed on the exterior housing; and an exterior conductive shield supported by the exterior housing, the shield including a collar with a hollow interior that receives part of the exterior housing therein, the collar contacting the at least one exposed portion of the extension member.

22. The cable connector of claim 21, wherein the extension member includes a length of foil tape extending around the internal body portion, and the housing includes a front face, the leading edge projecting past the front face and the foil tape extending on the internal body portion to a location proximate to the front face.

23. The cable connector of claim 22, wherein the housing includes at least two slots formed therein extending therethrough and communicating with the extension member, each slot including a contact member therein, each contact member contacting the extension member and the shield at opposite ends of the contact member.

24. The cable connector of claim 23, wherein the shield further includes a plurality of contact arms that extend outwardly therefrom for contacting an exterior shell when mated to the opposing connector.

* * * * *